United States Patent [19]

Miyazaki et al.

[11] Patent Number: 4,501,207

[45] Date of Patent: Feb. 26, 1985

[54] HOLE SEWING MACHINE

[75] Inventors: Hiroshi Miyazaki; Masahisa Kato, both of Aichi, Japan

[73] Assignee: Mitsubishi Denki Kabushiki Kaisha, Japan

[21] Appl. No.: 461,305

[22] Filed: Jan. 26, 1983

[30] Foreign Application Priority Data

Jan. 26, 1982 [JP] Japan ..... 57-9003[U]

[51] Int. Cl.[3] ..... D05B 3/00

[52] U.S. Cl. ..... 112/66; 112/158 B; 112/121.15; 112/121.12

[58] Field of Search ..... 112/66, 76, 65, 70, 112/73, 158 B, 121.15, 121.12

[56] References Cited

U.S. PATENT DOCUMENTS 2,555,095 3/1951 Reece ..... 112/65
4,181,083 1/1980 Bajer et al. ..... 112/70
4,381,720 5/1983 Abrams ..... 112/121.15

FOREIGN PATENT DOCUMENTS 2831116 1/1979 Fed. Rep. of Germany ..... 112/65

*Primary Examiner*—Ronald Feldbaum
*Attorney, Agent, or Firm*—Sughrue, Mion, Zinn, Macpeak and Seas

[57] ABSTRACT

In a hole sewing machine of the type adapted to stitch a buttonhole or the like, an X-Y table member is operatively connected to a work support member upon which the material to be stitched is placed, motors are provided for driving the table along orthogonal X-Y axes and a further motor is provided for synchronously rotating the needle bar and looper stand of the sewing machine about the axis of the needle bar. A control device is provided for supply drive signals to the various motors in accordance with the predetermined buttonhole sewing program so that the buttonhole is stitched in accordance with the desired pattern by merely selecting a specific buttonhole sewing program.

12 Claims, 8 Drawing Figures

HOLE SEWING MACHINE

BACKGROUND OF THE INVENTION

The present invention is directed to a hole machine, more specifically to a sewing machine for forming buttonholes or the like with lock stitches and chain stitches.

In general, a hole sewing machine is comprised of a sewing machine head, a support stand upon which the head is mounted, an electric motor for driving the head and transmission means between the motor and the head. The various mechanisms for forming the stitches are associated with the sewing machine head and include a needle bar mechanism, a feed mechanism, a looper-spreader mechanism, a cloth clamping mechanism, a cloth cutting mechanism, a sector mechanism, a looper stand mechanism, and a clutch mechanism. The feed mechanism includes cam means for controlling the movement of the needle along a button-hole shaped path and for operating the button hole cutting means.

In the operation of such a conventional buttonhole sewing machine, the sewing machine is started and upon operation of the suitable clutch mechanism the feed mechanism is energized to perform a sewing operation along the configuration of an eyelet hole which is determined by the cam means. In order to prevent irregular stitching during the sewing of the eyelet hole, the needle bar and looper stand are turned in synchronism with the stitches by the action of the cam means. When the desired number of stitches have been completed, the cloth cutting means is operated to complete a single cycle of operation and the sewing machine is automatically stopped. Depending upon the specifications of the sewing operation, the cloth cutting means may be operated prior to the sewing operation.

In the conventional buttonhole sewing machine the shape of the buttonhole is uniformly determined by the configuration of the sewing machine head and the associated cam means. Thus, while it is often desired to produce buttonholes in various patterns, the conventional buttonhole sewing machine cannot produce the various patterns. More specifically, in order to change the buttonhole sewing pattern, it is necessary to change a large number of components in the sewing machine, including the cam means for the feed mechanism. The adjustment of the length of the line portion of the buttonhole and pitch of the buttonhole sewing stitches requires specialized tools and a considerable amount of delicate adjustment work. In addition, it is impossible to separately adjust the pitch of the stitches for the straight part of the buttonhole and the round part of the buttonhole.

SUMMARY OF THE INVENTION

The present invention provides a new and improved buttonhole sewing machine in which a number of buttonhole sewing patterns having a variable pitch for buttonhole stitches can be obtained by selecting programmed data by suitable switching means.

The present invention provides a new and improved buttonhole sewing machine including a work support member upon which cloth retaining means are provided which is coupled to a sliding plate which is driven by an X-axis motor and an Y-axis motor. A rotating mechanism for sychronously rotating the needle bar and looper stand and a device for supplying drive signals to the rotating mechanism according to a predetermined hole sewing program are also provided so that a buttonhole is stitched in the desired pattern in accordance with the selection of a specific buttonhole sewing program.

The foregoing and other features and advantages of the invention will be apparent from the following more particular description of a preferred embodiment of the invention as illustrated in the accompanying drawings.

FIGS. *3a–3e* are explanatory diagrams for the buttonhole sewing pattern according to the present invention.

Figure 4:
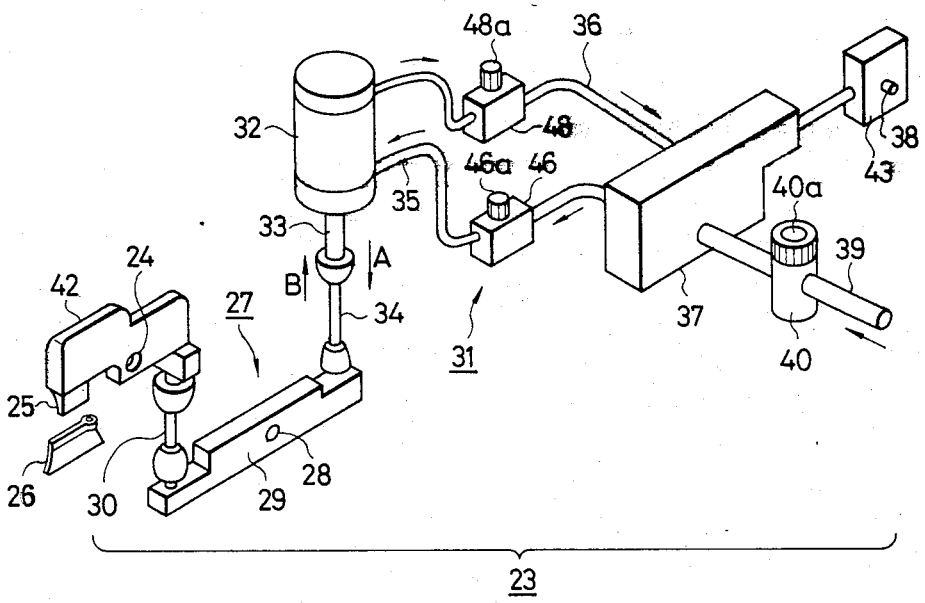

FIG. 4 is a schematic view showing the central components of the cloth cutting device according to the present invention.

DETAILED DESCRIPTION OF THE INVENTION

Figure 1:
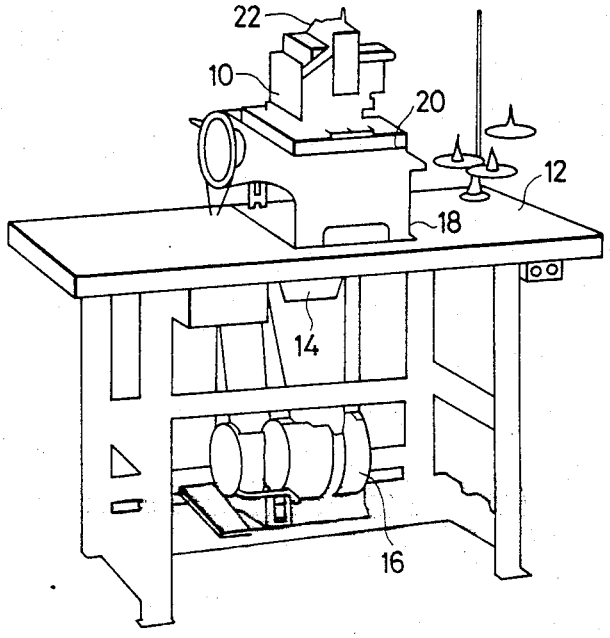
FIG. 1 is a perspective view showing a buttonhole sewing machine in accordance with the present invention.

The buttonhole sewing machine according to the present invention as shown in FIG. 1 is comprised of a sewing machine head 10, a table stand 12, a motor 14 for driving the head 10 and a transmitter 16 provided for transmitting rotation from the motor 14 to the head 10. The sewing machine head 10 includes a support base 18, a bed 20 and an arm 22. All the mechanisms for forming the stitches are carried by the support with the details of the feed mechanism being shown in FIG. 2.

Figure 2:
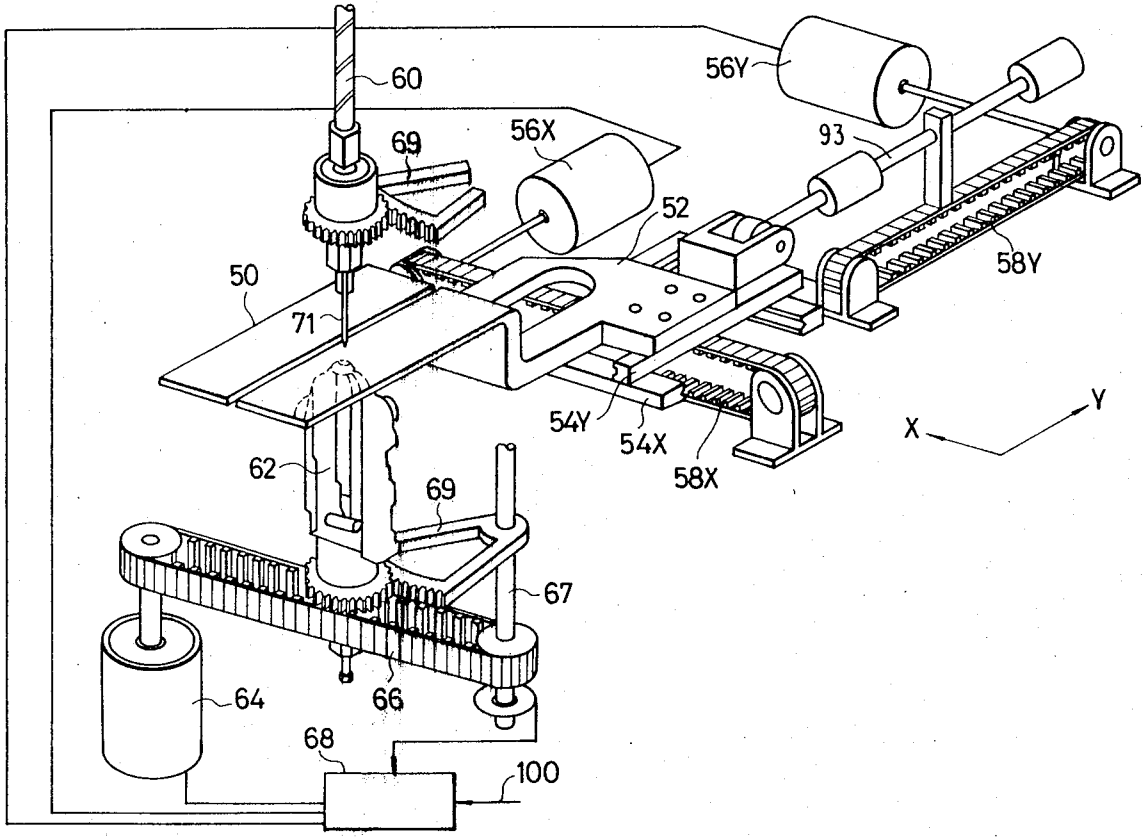
FIG. 2 is a schematic view of the essential components of the buttonhole sewing machine according to the present invention.

In FIG. 2 the work support member 50, upon which suitable cloth retaining means (not shown) are installed, is coupled to sliding plate 52 which is moveable in the direction of the arrows X and Y. More specifically, the plate 52 is mounted for movement in opposite directions along the Y axis on the guide means 54Y which in turn is mounted for movement in opposite directions along the X axis on the guide means 54X. An X-axis stepping motor 56X drives a timing belt 58X in opposite directions which in turn is operatively connected to the guide means 54Y for moving the same along the X axis guide means 54X. Likewise, the Y axis stepping motor 56Y rotates the timing belt 58Y in opposite directions with the timing belt 58Y being operatively connected to the plate 52 through the rod 93 for moving the same along the Y axis guide means 54Y. The foregoing components which constitute the X-Y movement system are located below the bed 20 of the sewing machine.

A needle bar 60 and a looper stand 62 are rotatably mounted in the sewing machine and are sychronously rotated under the control of the stepping motor 64 which operates the timing belt 66 in opposite directions for rotating the shaft 67. A pair of gear segments 69 are secured to the shaft 67 for rotation therewith and are operatively meshed with complementary gears on the needle bar 60 and the looper stand 62.

The stepping motors 56X and 56Y for driving the sliding plate 52 and the stepping motor 64 for rotating the needle bar 60 and the looper stand 62 are controlled by a stored program system control device 68. Control data in the system is selectively set for the motors by operating a buttonhole configuration selecting switch, a buttonhole pattern contracting and enlarging dial, a buttonhole link dial, a seam length dial, and a sewing speed dial. More specifically, when the setting inputs 100 are applied to the control device 68, the stepping motor is operated in synchronism with the vertical movement mechanism for the needle bar 60 so that the needle bar 60 coupled to the sewing needle 71 and the looper stand 62 are turned in a range from 0° to 360° during a buttonhole sewing operation. Control programs for a variety of buttonhole configurations, as for example the eyelet hole shown in FIG. 3, are stored in the control device 68 so that buttonholes of different configurations can be selected and stitched as required.

Figure 3A:
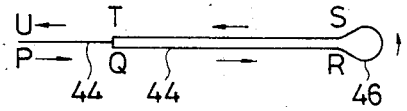
Figure 3B:
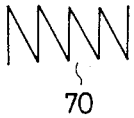
Figure 3C:
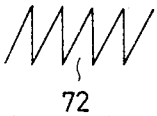
Figure 3D:
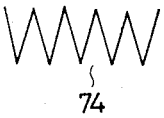
Figure 3E:
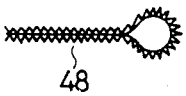

A typical example of a buttonhole will be described with reference to FIGS. 3*a*–3*e* wherein the buttonhole is comprised of a line portion 44 and a round portion 46. Several patterns are provided for the round portion 46 and the buttonhole is stitched as follows. The cloth is first cut according to the sewing pattern with the cloth cutting device 23 described hereinafter. The needlebar 60 is operated along the length of the hole in a zigzag pattern to form a seam 48 as shown in 3*e*. Three different zigzag patterns 70, 72, and 74, as shown in FIGS. 3*b*, 3*c*, and 3*d*, respectively, can be obtained by selecting a specific timing feed for the X-Y sliding plate. The pattern of the round portion 46 may be contracted or enlarged in the X or Y direction. In a single cycle buttonhole sewing operation from the point P to the point U in FIG. 3*a*, the length PQ and QR in the line portion 44 can be adjusted as required and the size of the round portion 46 can also be selected as required.

A cloth cutting device 23 as shown FIG. 4 is provided for cutting a piece of cloth along the length of the buttonhole before or after the buttonhole is stitched. The device 23 is carried by a support adjacent the bed 20 of the sewing machine and the support stand 18. A movable cutting anvil is detachably secured to the end of a support lever 42 which is rotatably mounted on a fulcrum (not shown) which extends through the opening 24. The moveable cutting anvil is operatively opposed to a knife 26 so that the cutting of the buttonhole is accomplished by the two cutting elements upon pivotable movement of the lever 42.

A link mechanism 27 is provided to drive the moveable anvil with respect to the knife 26. The link mechanism 27 is comprised of a drive lever 29 adapted to be rotatably mounted on a shaft (not shown) extending through the opening 28. One end of the drive lever 29 and one end of the lever 42 are pivotably coupled to each other by means of a rod 30. An air drive device 31 for driving the moveable anvil 25 is comprised of an air cylinder 32 having a piston shaft 33 pivotally connected to the drive lever 29 by means of the rod 34. An air compressor (not shown) supplies air to a solenoid control valve 37 through a pipe 39 having a pressure regulator 40 associated therewith. Air is supplied to and from the cylinder 32 by means of an air supply pipe 35 and an air discharge pipe 36, both of which are connected to the solenoid control valve. Upon energization of the solenoid valve 37, the air which is supplied through the pipe 39 from the compressor is delivered through the air supply pipe 35 into the air cylinder 32. Upon de-energization of the solenoid 37, the air in the air cylinder 32 is discharged through the air discharge pipe 36. The energization of the solenoid valve 37 is programmed by a control means 43 so that the solenoid valve 37 is energized and de-energized at the desired times. The control means 43 has an anvil operation selecting switch 38 associated therewith so that the operation and non-operation of the hammer 42 are selected as required.

In order to adjust the operating speed of the moveable anvil 25, speed controllers 46 and 48 are provided in the air supply pipe 35 and the air discharge pipe 36, respectively. The speed controllers 46 and 48 may be needle valves which are adjustably controlled by the knobs 46*a* and 48*a* which are operatively associated with the speed controllers 46 and 48 respectively.

In order to control the operating pressure of the cutting anvil 25, the pressure control 40, which also may be a needle valve, can be adjusted under the control of the knob 40*a*.

Upon receiving a pre-set signal from the control means 43, the solenoid valve 37 is energized so that air is supplied from the air compressor through the pipe 39 and the air supply pipe 35 into the air cylinder 32. As a result, the piston shaft 33 is moved in the direction of the arrow A in FIG. 4 to pivot the drive lever arm 29 in the clockwise direction, thereby pivoting lever 42 in the counter-clockwise direction. The cutting anvil 25 is moved into cooperative relation with the knife 26 to cut a buttonhole having a desired configuration in the cloth. Upon completion of the cutting of the buttonhole, the solenoid valve 37 is de-energized so that the air in the air cylinder 32 is discharged through the air discharge pipe 36. As a result, the shaft 33 is moved in the direction of the arrow B under the influence of a spring (not shown) in cylinder 32 and the cutting anvil 25 is returned its original position. The stroke of the anvil 25 can be controlled by changing the period of excitation of the solenoid valve 37. Thus, depending upon the thickness of the piece of cloth, the stroke can be set to the most suitable length.

Furthermore, the operating speed of the cutting anvil 25 can be controlled by the adjusting valves 46*a* and 48*a* of the speed controllers 46 and 48. Therefore, the cloth cutting can be carried out at any desired speed. In addition, the operating pressure of the cutting anvil 25 can be controlled by turning the adjusting valve 40*a* of the pressure control 40. Therefore, depending on the thickness of the piece of cloth being subjected to the buttonhole cutting operation, the cloth cutting pressure can be set to the most suitable valve within the range which is allowed by the mechanical strength of the various components including the cutting anvil 25 and the stationary knife 26.

Thus, by using only a single buttonhole sewing machine according to the present invention various buttonholes having different configurations can be stitched. In a buttonhole sewing machine according to the present invention, unlike conventional buttonhole sewing machines, intricate cam mechanisms and coupled link mechanisms are substantially excluded. Accordingly, the buttonhole sewing machine of the present invention is very high in mechanical reliability, low in manufacturing cost and high in application and flexibility.

While the invention has been particularly shown and described with reference to a preferred embodiment thereof, it will be understood by those in the art that various changes in form and details may be made therein without departing from the spirit and scope of the invention.

We claim:

1. A hole sewing machine comprising a sewing mechanism including a needle bar having a sewing needle coupled thereto, and a looper stand, support means for supporting a fabric workpiece mounted for movement along an X-axis and a Y-axis orthogonal to each other, an X-axis direction feed motor for moving said support means in the direction of said X-axis, a Y-axis direction feed motor for moving said support means in the direction of said Y-axis, rotating means for sychonronously rotating said needle bar and said looper stand and control means for supplying driving signals to said rotating means according to a predetermined hole sewing program.

2. A hole sewing machine as set forth in claim 1 wherein said X axis direction feed motor is a stepping motor.

3. A hole sewing machine as set forth in claim 1 wherein said Y axis direction feed motor is a stepping motor.

4. A hole sewing machine as set forth in claim 1 wherein said rotating means includes a torque generating motor.

5. A hole sewing machine comprising stitching means including a needle bar having a sewing needle coupled thereto and a looper stand, table means mounted for movement along an X-axis and a Y-axis orthogonal to each other, an X-axis direction feed motor for moving said support means in the direction of said X-axis, a Y-axis direction feed motor for moving said support means in the direction of said Y-axis, rotating means for sychronously rotating said needle bar and said looper stand and control means for applying drive signals to said rotating means, said X-axis direction feed motor and said Y-axis direction feed motor in accordance with the predetermined hole sewing program.

6. A hole sewing machine as set forth in claim 5 wherein said X-axis direction feed motor is a stepping motor.

7. A hole sewing machine as set forth in claim 5 wherein said Y-axis direction feed motor is a stepping motor.

8. A hole sewing machine as set forth in claim 5 wherein said rotating means includes a torque generating motor.

9. A hole sewing machine as set forth in claim 5 further comprising a first timing belt is operably coupled to said support means and said X-axis direction feed motor and a second timing belt is operably connected between said support means and said Y-axis direction feed motor.

10. A hole sewing machine as set forth in claim 5 wherein said rotating means includes a torque generating motor, shaft means operably coupled to said torque generating motor and arm means operatively coupled to said shaft and said needle bar and looper stand for rotating said needle bar and looper stand.

11. A hole sewing machine as set forth in claim 10 further comprising a third timing belt operably coupled to said shaft and said torque generating motor whereby said shaft is turned by means of said third timing belt.

12. A hole sewing machine as set forth in claim 10 wherein said torque generating motor is a stepping motor.

* * * * *